United States Patent [19]

Sikirov

[11] Patent Number: 4,819,277

[45] Date of Patent: Apr. 11, 1989

[54] SANITARY APPLIANCE

[76] Inventor: Berko Sikirov, 6 Menachem Street, Bnei-Brak 51 403, Israel

[21] Appl. No.: 105,142

[22] Filed: Oct. 6, 1987

[51] Int. Cl.[4] ..... E03D 11/00

[52] U.S. Cl. ..... 4/254; 4/239

[58] Field of Search ..... 4/237, 239, 254

[56] References Cited

U.S. PATENT DOCUMENTS

| | | | |
|---|---|---|---|
| 604,597 | 5/1898 | Bliss | 4/254 X |
| 4,012,797 | 3/1977 | Kristoffersen | 4/254 X |

FOREIGN PATENT DOCUMENTS

| | | | |
|---|---|---|---|
| 214667 | 10/1909 | Fed. Rep. of Germany | 4/237 |
| 21458 | of 1900 | United Kingdom | 4/254 |
| 1434937 | 5/1976 | United Kingdom | 4/237 |

*Primary Examiner*—Charles E. Phillips

*Attorney, Agent, or Firm*—Benjamin J. Barish

[57] ABSTRACT

A sanitary appliance comprises a platform mountable over a toilet bowl and formed with an opening therethrough aligned with the toilet bowl. The platform is constructed to support a user in a natural squatting position over the opening and the toilet bowl, and includes a pan located to serve as a urinal pan when the user is in the squatting position.

17 Claims, 2 Drawing Sheets

SANITARY APPLIANCE

BACKGROUND OF THE INVENTION

The present invention relates to sanitary appliance, and particularly to a novel toilet construction permitting defecation in a position found beneficial for the treatment of hemorrhoids, constipation, or similar ailments. The invention also relates to a unit which may be applied to or over a conventional toilet for the above purpose.

Hemorrhoids are one of the most common ailments afflicting mankind. A large number of etiologic and pathogenic theories have been proposed attempting to explain the cause of this ailment, but the large number of theories merely attests to the lack of any real understanding of the underlying etiological factors. The present invention is based on a study which has led to the conclusion that the conventional sitting posture during defecation, as dictated by the conventional sitting-type toilet seat, is unnatural for humans and is a major cause for this above ailment.

Sanitary appliances permitting defecation in the natural squatting position have been proposed long ago, as illustrated by U.S. Pat. No. 604,597 of May 24, 1898 and British Pat. No. 113,250 of Feb. 14, 1918. However, none of these appliances has found widespread use.

BRIEF SUMMARY OF THE INVENTION

An object of the present invention is to provide a novel sanitary appliance permitting defecation in a natural squatting position, which position has been found to be highly beneficial in the treatment and management of hemorrhoids. Another object of the invention is to provide an attachment to a conventional toilet bowl which permits defecating in the natural squatting position.

According to the present invention, there is provided a sanitary appliance comprising a platform mountable over a toilet bowl and formed with an opening therethrough aligned with the toilet bowl, which platform is constructed to support a user in a natural squatting position over the opening and over the toilet bowl, and includes a pan urinal located to serve as a urinal pan when the user is in the squatting position. The urinal pan is pivotally mounted to the platform to either an operative inclined position, or an inoperative folded position with respect to the platform.

In the preferred embodiment of the invention described below, the appliance further includes a water discharge nozzle for rinsing the pan into the toilet bowl. In the described preferred embodiment, the water discharge nozzle is an elongated pipe extending transversely across the outer end of the urinal pan and formed with a plurality of water discharge openings along its length.

According to another aspect of the invention, there is provided a sanitary appliance comprising a toilet bowl and a platform as described above mounted over the toilet bowl.

As will be shown by clinical data set forth below, the performance of defecation in the natural squatting position, rather than in the conventional sitting position, as permitted by the sanitary appliance of the present invention, has been found to be highly beneficial in a large number of cases in the treatment and management of hemorrhoids.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
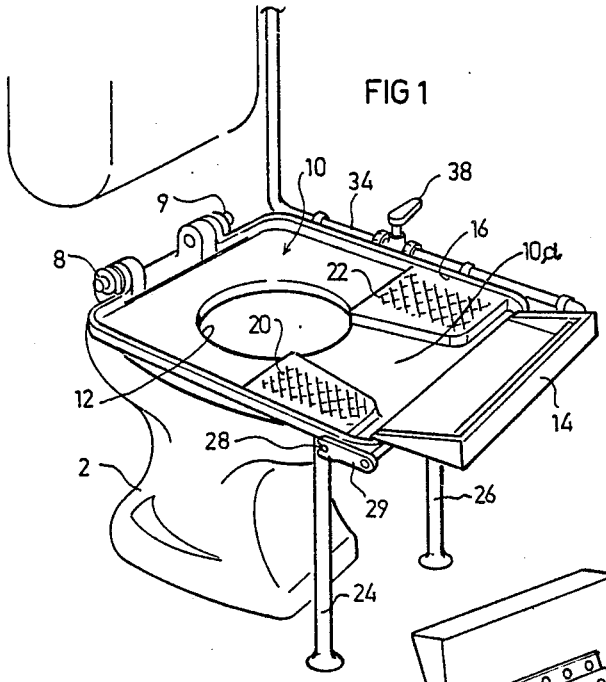
FIG. 1 illustrates a sanitary appliance, namely a toilet bowl, equipped with an attachment in accordance with the present invention, with the attachment being shown in its horizontal operative position.

FIG. 1 illustrates a sanitary appliance in the form of a conventional toilet bowl 2, including a toilet seat 4 pivotally mounted to the rear side of the toilet bowl via a pair of pins 8 and 9. The illustrated appliance further includes an attachment in the form of a platform, generally designated 10, mountable over the toilet bowl 2 and formed with an opening 12 therethrough aligned with the toilet bowl. Platform 10 is pivotally mounted by pins 8, 9 to the rear side of the toilet bowl over seat 4, and projects forwardly of the seat. As will be described more particularly below, the platform is constructed to support a user in a natural squatting position over opening 12 and the toilet bowl. It includes a pan 14 located to serve as a urinal when the user is in this squatting position.

Figure 2:
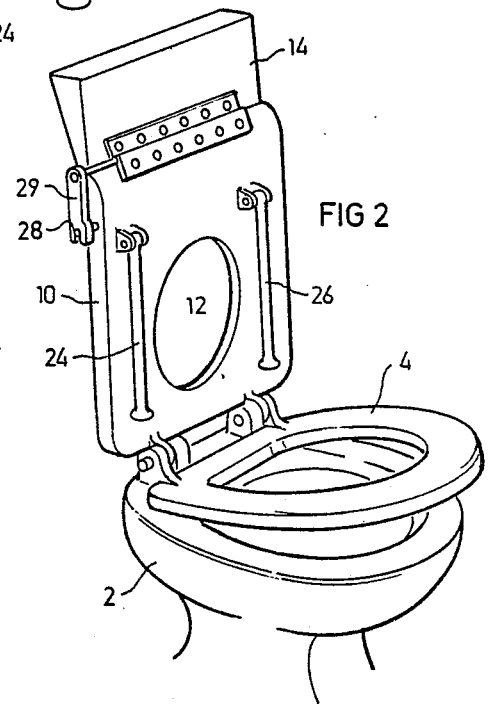
FIG. 2 illustrates the sanitary appliance of FIG. 1 with the attachment shown in its vertical inoperative position.

FIG. 1 illustrates platform 10 in its horizontal operative position, and FIG. 2 illustrates it in its vertical inoperative position.

Figure 5:
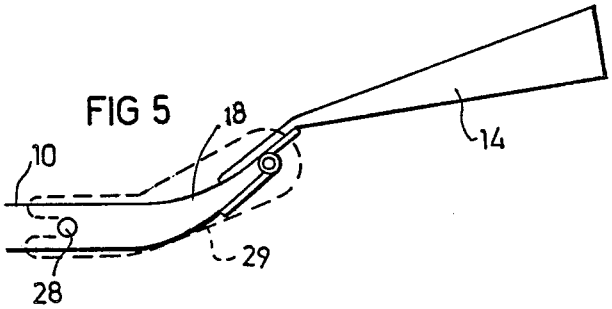
FIG. 5 is a side elevational view of the portion of the sanitary appliance illustrated in FIG. 4.

The main section of platform 10 is of generally planar construction but is formed on its upper face with a raised rim 16 around its circumference except for its front side 18 adjacent urinal pan 14 which is inclined upwardly, as shown particularly in FIG. 5. Platform 10 is also formed with raised sections 20, 22 each having a configuration approximating the outline of a foot. The two raised sections 20, 22 are adapted to receive the feet of the user when in tee natural squatting position over opening 12 in the platform. As seen particularly in FIG. 1, the two raised feet sections 20, 22 are located slightly forwardly of opening 12 so that the user, when standing on the two sections 20, 22, and facing the front end of the appliance (that of the urinal pan 14) is able to assume a natural squatting position over opening 12 and the toilet bowl 2. As also seen in particular in FIG. 1, the ends of the two raised feet sections 20, 22 terminate at an edge of opening 12.

The illustrated appliance further includes a pair of legs 24, 26 pivotally mounted to the underface of platform 10. Thus, when platform 10 is in its operative horizontal position as illustrated in FIG. 1, legs 24, 26 would be pivoted downwardly to engage the floor and thereby to support the platform in this horizontal position; and when the platform is to be moved to its vertical inoperative position as illustrated in FIG. 2, legs 24, 26 would be pivoted against the underface of the platform.

Figure 3:
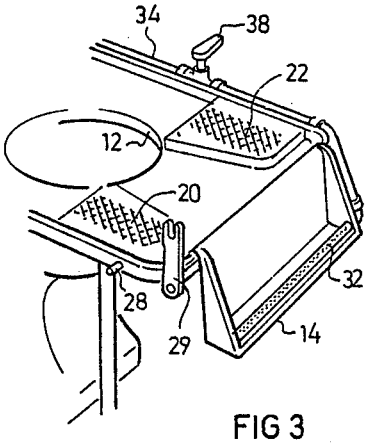
FIG. 3 is a fragmentary view of the sanitary appliance of FIG. 1 with the urinal pan in its inoperative folded position.

Pan 14 is carried at the front end of the platform in position to serve as an urinal when the user is in the natural squatting position with his feet on the raised feet sections 20, 22 and facing forwardly of the appliance. Urinal pan 14 is also pivotally mounted from an operative position illustrated in FIGS. 1, 4 and 5, to a non-operative folded position as illustrated in FIG. 3. A retainer pin 28 at the front end of platform 10 is comparable with the notched end of a handle 29 for releasably retaining pan 14 in its operative position.

When the urinal pan 14 is in its operative position (FIGS. 1, 4 and 5), it is inclined downwardly from its outer end towards platform 10 for draining the urine from the pan via opening 12 into the toilet bowl. For this purpose, the front portion 10*a* of platform 10 between the two raised feet sections 20, 22 may also be inclined downwardly towards opening 12, and the pan 14 may be given a slight concave configuration along its transverse axis, as shown in FIG..4, to channel the draining fluids towards the center of platform section 10*a*. As described earlier, the raised feet sections 20, 22 extend to the edge of opening 12, and thereby channel the draining fluid from the urinal pan 14 via section 10*a* and opening 12 into the toilet bowl.

Figure 4:
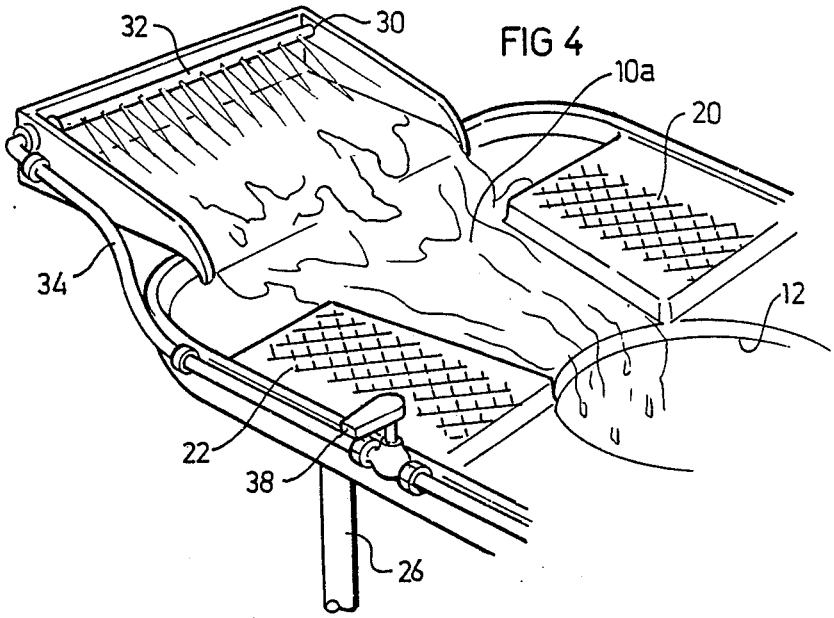
FIG. 4 is a fragmentary view of the appliance of FIG. 1 with the urinal pan in its operative position and being rinsed after use.

The urinal pan 14 is provided with a water discharge nozzle, best seen at 30 in FIG. 4, for rinsing it into the toilet bowl 2 via platform section 10*a* and opening 12. Water discharge nozzle 30 is in the form of a tube extending transversely across the front end of the urinal pan 14 and is formed with a plurality of water discharge openings 32 along its length. Nozzle 30 is connected by a supply tube 34 to the water supply pipe and is controlled by the user via a manual valve 38.

The manner of using the illustrated sanitary appliance will be apparent from the above description.

Thus, when the appliance is to be used by a user in the conventional sitting position, platform 10 and urinal pan 14 would be in their vertical inoperative positions as illustrated in FIG. 2, and the toilet seat 4 would be in its operative position over the toilet bowl 2.

However, when the appliance is to be used while the user is in the natural squatting position, the platform 10 would be pivoted to its operative position and the pan in its folded (inoperative) position as illustrated in FIG. 3. The user then steps on the raised feet sections 20, 22 of platform 10, facing frontwardly, assumes the natural squatting position over opening 12 of the platform and toilet bowl 2 and pivots the pan to its operative position as illustrated in FIG. 1. In this position, pan 14 is so located to serve as a urinal. After the user has completed both defecation and urination, the user operates handle 38 to rinse the urinal pan via the water discharge from nozzle 30 into the toilet bowl 2.

The urinal pan 14 may also be pivotted to the inoperative folded position illustrated in FIG. 3.

Clinical data is set forth below which shows the beneficial results obtainable in the treatment of hemorrhoids by defecating in the squatting position as permitted by the use of the novel toilet construction illustrated in the drawings. It will be appreciated that the novel arrangement, since it permits defecation without contact with the toilet seat, also provides protection against the spread of infectious diseases.

CLINICAL DATA

A clinical study was performed with a group of 20 patients suffering from hemorrhoids. The distribution of cases by anamnestic events connected with the beginning of hemorrhoids is shown in Table I. Hemorrhoids, once having appeared, were perpetuated in spite of the fact that the initiating event was eliminated. In some cases, patients denied the existence of an initiating factor. As is shown in Table II, all the patients had undergone conventional treatment prescribed by the family physician or surgeon. The therapies included high-fiber diet, suppositories, salves, laxative preparations, etc., which the patients had tried for many months. In all cases, patients noted only temporary relief. Two patients had undergone ligation for prolapsing hemorrhoids, with temporary improvement. One patient had ligation for severe hemorrhoidal bleeding, the ligation complicated by severe pain upon every defecation attempt.

Each patient entering the study was examined by rectoscopy on his first visit to rule out pathological lesions other than hemorrhoids. In accordance with the thesis proposed above, all 20 patients received detailed instructions for changing their defecation posture and habits as follows:

(a) to perform the defecation act in the squatting position, exclusively. In order to assume the squatting position freely, and in the absence of a squatting water closet, they were advised to collect the feces on a piece of cardboard;

(b) to attempt defecation only in response to a strong urge to empty the bowels; to emphasize this point, they were advised to postpone the attempt until absolutely certain of the necessity to go to stool.

Since pressure in the rectum and sphincter area is a natural, familiar indication of the need to pass stool, a one-time explanation usually sufficed, and most patients were able to follow the advice with ease. The patients were also instructed that under socially inhibited circumstances, the act of defecation could be postponed, but again, performed only in response to another stimulus to evacuate.

As is shown in Table II, as a consequence of changing defecation posture and habits, the different manifestations of hemorrhoids subsided in most patients and there was no relapse during a follow-up period of one year. Especially rapid and dramatic were cessation of bleeding in the group of patients with first-grade internal hemorrhoids. Cessation of pain in external or internal hemorrhoids was gradual, completely disappearing in as little as two weeks. The period of time needed for cessation of prolapse of hemorrhoids in the patients with second and third degree internal hemorrhoids varied between 2 to 4 months. The examination of these patients by palpation and proctoscopy after a follow-up period of one year did not reveal again abnormal pile swellings.

The examination of the patients with external hemorrhoids, as performed after a follow-up of one year, did not reveal in the anal region significant skin tags or any other abnormalities.

Two patients with third degree internal hemorrhoids who earlier underwent ligation, noted only partial diminution of prolapse, and no definitive improvement was detected in these patients on follow-up proctolic examination.

The concept of excessive straining at defecation as a factor in perpetuation of hemorrhoids is confirmed definitely by the clinical data described above. The study showed that most patients who suffered from different manifestations of hemorrhoids, and who changed from the sitting defecation posture and fixed time of defecation habits (both associated with excessive straining) to a squatting defecation posture and defecation on urge (which required only minimal straining) enjoyed a significant reduction in the manifestation of hemorrhoids.

While the invention has been described with respect to one preferred embodiment, it will be appreciated that many variations may be made. For example, platform 10 may be constructed as a separate unit to be applied over or attached to the toilet bowl whenever the user wishes to use the bowl while in the natural squatting position. Many other variations, modifications and applications of the invention will be apparent.

TABLE I

Distribution of cases by anamnestic events connected with the beginning of hemorrhoidal disease

| Patient No. | Anamnestic events cited by the patient |
|---|---|
| 1, 4, 5, 6, 16 | Life stress event; frequent defecation attempts; constipation |
| 2, 15, 18 | Bout of constipation connected with sudden change of diet |
| 12, 14 | Recurrent bout of diarrhea |
| 17, 19, 20 | Pregnancy, postpartum period |
| 8 | Heavy physical effort |
| 3, 7, 9, 10, 11, 13 | Patient denies any initiating factor |

TABLE II

The Effect of Natural Defecation Posture and Habit on Hemorrhoids

| Patient No. Sex/Age | Type of Hemorrhoid | Manifestations | Duration of Ailment | Conventional Treatment | Results of Conventional Treatment | Results After Adoption of Described Defecation Regime |
|---|---|---|---|---|---|---|
| 1. M/40 | internal | bleeding | 2 years | suppositories | no definite improvement | cessation of bleeding within 10 days |
| 2. M/22 | internal | bleeding | 1 year | suppositories | no definite improvement | cessation of bleeding within 1 wk |
| 3. M/56 | internal | bleeding | 4 years | suppositories | no definite improvement | cessation of bleeding within 10 days |
| 4. M/49 | internal | bleeding | 4 years | suppositories | no definite improvement | cessation of bleeding within 1 month |
| 5. M/35 | internal | bleeding | 2 years | suppositories | no definite improvement | cessation of bleeding within 10 days |
| 6. M/30 | internal | bleeding | 1 year | suppositories | no definite improvement | cessation of bleeding within 10 days |
| 7. M/40 | internal | severe bleeding | 1 year | ligation | 8 months of intractable pain and occasional slight bleeding on defecation | cessation of pain and bleeding within 3 weeks. |
| 8. M/25 | external | pain on defecation and sitting | 3 months | suppositories | temporary relief | cessation of pain within 2 weeks |
| 9. F/50 | external, internal | pain on defecation and sitting | 1 year | suppositories, laxative prep. | temporary relief | cessation of pain within 2 weeks |
| 10. F/55 | external, internal | pain on defecation and sitting | 1 year | suppositories, laxative prep. | temporary relief | cessation of pain within 2 months |
| 11. M/55 | external | pain on defecation and sitting | 2 months | salves, suppositories, diet | temporary relief | cessation of pain within 2 weeks |
| 12. M/30 | internal, grade II | prolapse on defecation, pain | 1 year | suppositories, diet | no improvement | cessation of pain and prolapse within 1 month |
| 13. M/70 | internal, grade III | prolapse on defecation | 9 years | ligation | recurrence after ½ year | partial diminution of prolapse |
| 14. M/48 | internal grade III | prolapse on defecation, bleeding | 10 years | ligation | recurrence after 2 years | partial diminution of prolapse |
| 15. M/45 | internal grade III | prolapse on defecation | 9 years | diet, laxat. preparation | no improvement | cessation of prolapse within 2 months |
| 16. M/36 | internal grade III | prolapse on defecation | 3 years | diet, "zeroid" device | no improvement | cessation of prolapse within 2 months |
| 17. F/50 | internal grade II | prolapse on defecation, bleeding | 18 years | suppositories, laxative prep. | no improvement | cessation of prolapse and bleeding within 2 months |
| 18. M/60 | internal grade III | prolapse on defecation | 20 years | suppositories, diet | no improvement | cessation of prolapse within 4 months |
| 19. F/33 | external, severely thrombosed | pain and bleeding on defecation; pain on sitting | 2 months, postpartum | suppositories, salves, diet, liquid paraffin | temporary relief | cessation of pain and bleeding within 2 weeks |
| 20. F/25 | external, severly thrombosed | pain on defecation and sitting | 3 months, postpartum | diet, liquid paraffin | temporary relief | cessation of pains within 2 weeks |

What is claimed is:

1. A sanitary appliance comprising a platform mountable over a toilet bowl and formed with an opening therethrough aligned with the toilet bowl; said platform being constructed to support a user in a natural squatting position over said opening and over the toilet bowl, and including a urinal pan located to serve as a urinal when the user is in said squatting position; said urinal pan being pivotally mounted to said platform to either an operative inclined position, or to an inoperative folded position with respect to said platform.

2. The sanitary appliance according to claim 1, further including a water discharge nozzle for rinsing the urinal pan into the toilet bowl.

3. The sanitary appliance according to claim 2, wherein said water discharge nozzle is an elongated pipe extending transversely across the outer end of the urinal pan and formed with a plurality of water discharge openings along its length.

4. The sanitary appliance according to claim 3, wherein said water discharge nozzle is connected to a water supply via a manual valve.

5. The sanitary appliance according to claim 1, wherein said platform includes raised sections on its upper surface for receiving the feet of the user when in said natural squatting position.

6. The sanitary appliance according to claim 5, wherein said raised sections on the upper surface of the platform are forwardly of said opening through the platform.

7. The sanitary appliance according to claim 1, further including legs mounted to the platform for supporting same and the user thereon.

8. The sanitary appliance according to claim 7, wherein said legs are pivotably mounted to the underside of said platform.

9. The sanitary appliance according to claim 1, wherein said platform is pivotally mounted to said toilet bowl to either an operative horizontal position or to an inoperative vertical position.

10. A sanitary appliance comprising a toilet bowl and a platform mounted thereover and formed with an opening therethrough aligned with the toilet bowl; said platform being constructed to support a user in a natural squatting position over said opening and over the toilet bowl, and including a urinal pan at one end located to serve as a urinal when the user is in said squatting position; and urinal pan being pivotally mounted to said platform to either an operative inclined position, or to an inoperative folded position with respect to said platform.

11. The sanitary appliance according to claim further including a seat pivotally mounted to the toilet bowl under said pivotally mounted platform.

12. The sanitary appliance according to claim 10, further including a water discharge nozzle adjacent the outer end of the urinal pan for rinsing the pan into the toilet bowl.

13. The sanitary appliance according to claim 12, wherein said water discharge nozzle is an elongated pipe extending transversely across the outer end of the urinal pan and formed with a plurality of water discharge openings along its length.

14. The sanitary appliance according to claim 10, wherein said platform includes raised sections on its upper surface and forwardly of said opening for receiving the feet of the user when in said natural squatting position.

15. The sanitary appliance according to claim 10, further including legs mounted to the platform for supporting same and the user thereon.

16. The sanitary appliance according to claim 15, wherein said legs are pivotably mounted to the underside of said platform.

17. The sanitary appliance according to claim 10 wherein said platform is pivotally mounted to said toilet bowl to either an operative horizontal position or to an inoperative vertical position.

* * * * *